United States Patent [19]

Hansel

[11] 4,131,215

[45] Dec. 26, 1978

[54] DISPENSER WITH ADDITIVE OPTION

[75] Inventor: William B. Hansel, Media, Pa.

[73] Assignee: Sun Oil Company of Pennsylvania, Philadelphia, Pa.

[21] Appl. No.: 812,948

[22] Filed: Jul. 5, 1977

[51] Int. Cl.[2] ..... B67D 5/06

[52] U.S. Cl. ..... 222/26; 222/145; 222/183

[58] Field of Search ..... 222/23, 32, 33, 36, 222/37, 63, 71, 76, 135, 144.5, 145, 183, 25–28, 134; 235/92 FL; 364/465; 137/100, 101.21

[56] References Cited

U.S. PATENT DOCUMENTS

| | | | |
|---|---|---|---|
| 3,152,725 | 10/1964 | Copony et al. | 222/145 |
| 3,678,253 | 7/1972 | Johnston | 235/92 FL |

*Primary Examiner*—Stanley H. Tollberg
*Assistant Examiner*—H. Grant Skaggs
*Attorney, Agent, or Firm*—J. Edward Hess; Donald R. Johnson; Paul Lipsitz

[57] ABSTRACT

A system for dispensing gasoline and having an option which, if selected by the customer, automatically dispenses an additive with the gasoline and computes the price of the additive into the sale.

6 Claims, 2 Drawing Figures

DISPENSER WITH ADDITIVE OPTION

BACKGROUND OF THE INVENTION

The present invention relates generally to a system for dispensing a fuel such as gasoline into the fuel tank of a motor vehicle. More particularly the present invention pertains to such a dispensing system wherein the customer has an option to automatically have an additive dispensed along with the gasoline and wherein the price of the additive is automatically computed into the displayed sales price at the pump.

Additives to gasoline to perform various functions such as cleaning carburetors, valves, etc. are well known in the art. These additives are commonly sold in the prior art in small containers. A disadvantage with this method of purchasing additives is that the addition of the additive to the gasoline is often cumbersome, and frequently results in quantities of the additive being spilled rather than being directed into the fillpipe of the motor vehicle.

It is also known to inject an additive into a main stream of fluid. U.S. 4,007,755, for example, discloses a system for injecting a predetermined amount of additive fluid to a main stream in such a way as to keep the additive concentration in the main stream constant. Also, it is known to optionally blend motor fuels of different octanes as disclosed in U.S. 3,934,756. In the disclosure of this patent a mechanical system using a double-acting cam is employed to continuously blend fuels from two storage tanks.

In accordance with a disclosed embodiment, a system is disclosed for conveniently dispensing an additive along with fuel. The system is for use in conjunction with a typical prior art system for dispensing fuel having, an underground storage tank for the fuel, a pump for pumping the fuel from the underground tank during a dispensing operation, a meter for measuring the quantity of fuel dispensed, a computer for computing the cost for the quantity of fuel dispensed, and a display for displaying the quantity and cost of fuel dispensed. The disclosed embodiment allows a customer the option of having an additive automatically added to the dispensed fuel and the price of the additive automatically computed into the sale. The disclosed embodiment comprises a storage reservoir for the additive which is separate from the underground storage tank, an additional pump activated when desired, by fuel flow and coupled to the storage reservoir for pumping slugs of additive as required to the gasoline dispensing unit during a dispensing operation, an additional meter for metering the quantity of additive dispensed, a coupling means for coupling the output of the additional meter to the display to automatically add the cost of the dispensed additive to the displayed cost, and a selector means for selectively allowing, at the option of the customer, additive to be dispensed or not along with the dispensed fuel.

Further, in the disclosed embodiment the display comprises an electronic display responsive to electrical pulses to display the cost and quantity of the dispensed product. The system produces electrical pulses indicative of the cost of the fuel dispensed and electrical pulses indicative of the cost of the additive dispensed, and the electrical pulses indicative of the cost of additive are coupled to the display for inclusion with the electrical pulses indicative of the cost of fuel to determine the displayed cost. Further, electrical pulses indicative of the quantity of fuel dispensed are produced, and these electrical pulses are coupled to the additional pump which pumps additive in a pulsed fashion (i.e. not continuously) in response to these electrical pulses. This results in the additive being proportionately blended with the dispensed fuel. Further, in the disclosed embodiment the selector means is simply a switch for selectively coupling, or not, the electrical pulses indicative of quantity of fuel dispensed to the additional pump for the additive and for optionally coupling the electrical pulses indicative of the quantity of fuel dispensed to the second pump. Also, in the disclosed embodiment the switch is automatically reset to an open position before a new dispensing operation is started. Also, in the disclosed embodiment the storage reservoir is preferably located within the dispensing console.

DETAILED DESCRIPTION OF DISCLOSED EMBODIMENTS

Figure 1:
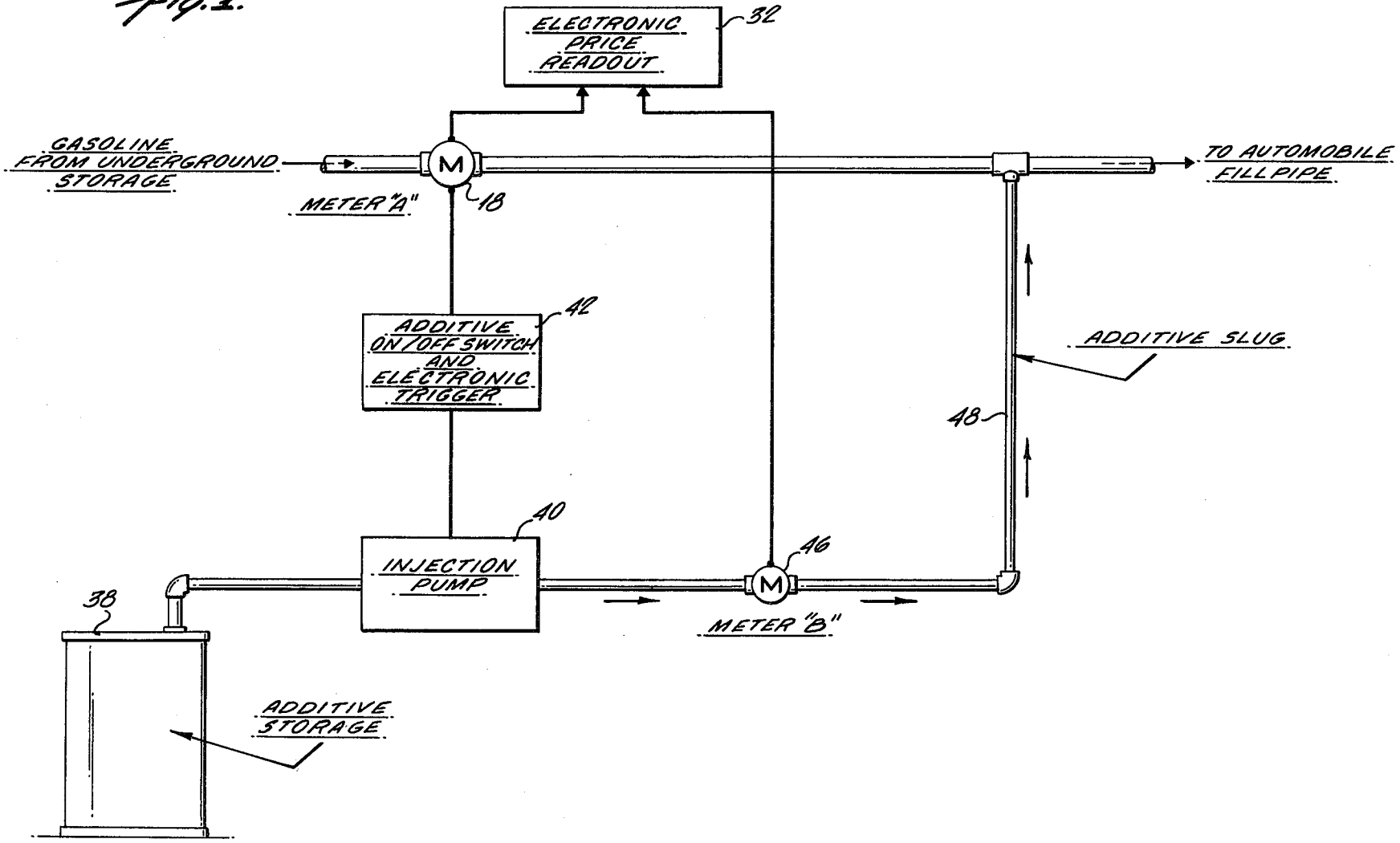
FIG. 1 is a block diagram illustrating the general form of the invention.

The general operational system is illustrated in FIG. 1 where, for example, meter A measures 1 pulse per gallon of gasoline being delivered. The pulse starts the injection pump, which delivers a slug of (say, 3cc), additive, then automatically shuts off. The slug, in passing through meter B, causes 1 pulse per cc of additive to be delivered to the price readout and each such pulse adds one cent to the price charged. By activating the readout off the additive slug, no price is charged unless a slug is actually delivered. A switch in the system makes it optional whether the additive is delivered or not. A plurality of options as to quantity of additive and choice of additive is provided by suitable modification of the switching means and injection pump operation. A hose within a hose, or side by side hoses, can be used to mix the additives and the gasoline at the nozzle. Special mixing means, to homogenize the mixture, can be employed, either at the nozzle or upstream.

Figure 2:
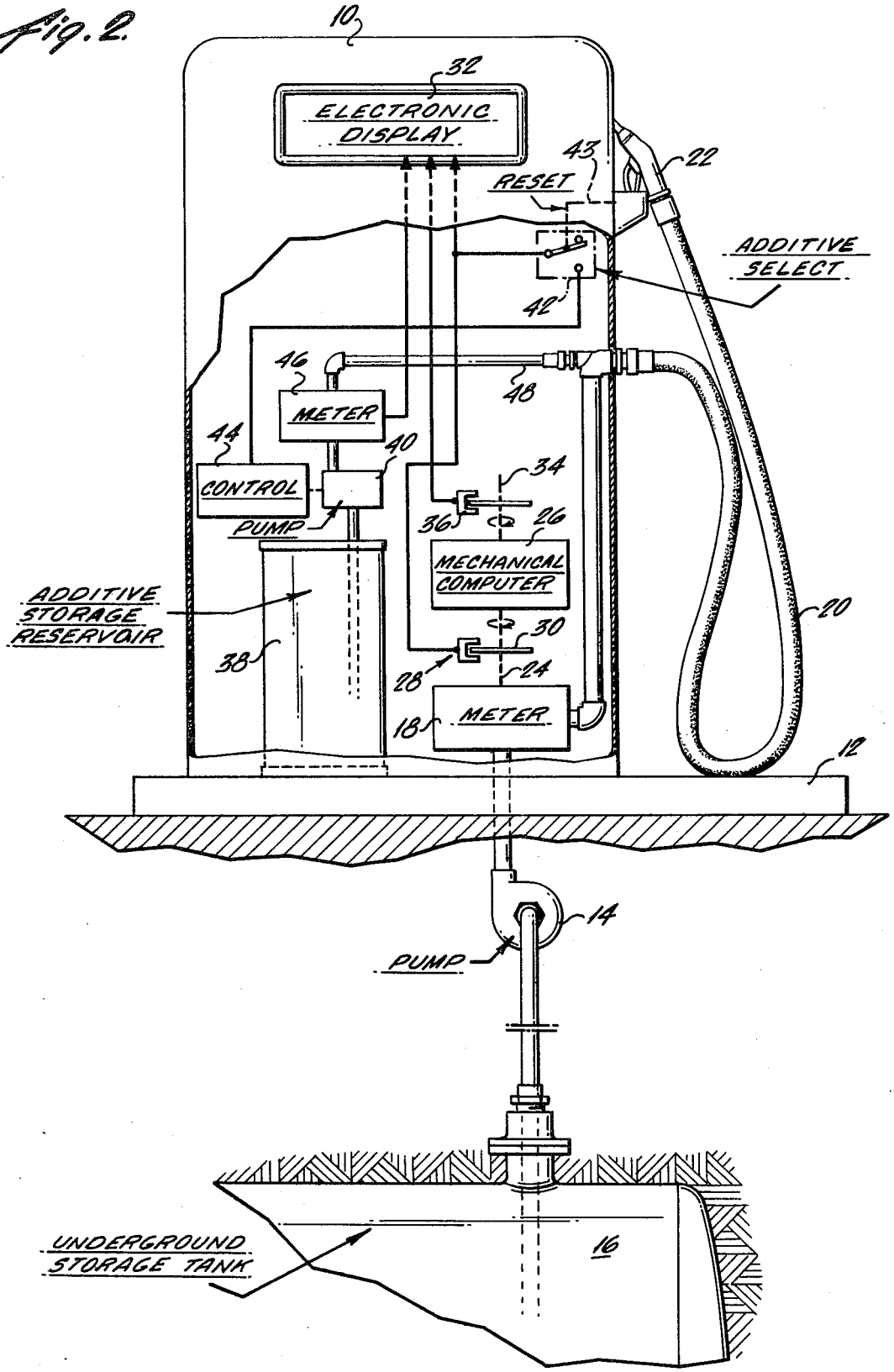
FIG. 2 illustrates in more detail one embodiment of a dispenser with an additive option wherein the additive is stored within the dispensing console.

Referring now to FIG. 2, for a more detailed description there is illustrated a typical gasoline dispensing console 10 which sits atop an elevated island 12 in a gasoline station. Dispensed product is pumped by a pump 14 from an underground storage tank 16. The dispensed product is directed through a meter 18 wherein the quantity of dispensed product is measured, and then through a flexible hose 20 to a nozzle 22, which is inserted into the fillpipe of a motor vehicle during a dispensing operation. The output of meter 18 is on a shaft 24 which rotates in proportion to the quantity of dispensed product. This shaft may drive a mechanical computer 26 which may rotate display wheels which display the price to the customer in accordance with a price per gallon setting within the mechanical computer. This arrangement is well known in the prior art, and need not be explained in detail here. The disclosed embodiment does not use such a mechanical display, but instead utilizes an electronic display. Electronic display are becoming fairly common in the market, and liquid crystals, light emitting diodes, Nixie tubes, etc. are utilized for the display. These electronic display typically include their own control circuitry, and are responsive to electrical pulses to control their operation.

A predetermined number of pulses per gallon may be generated by a commercially available pulse generator which will generate pulses in accordance with the rotational movement of a shaft. Such a pulse generator is illustrated schematically at 28, and may include a slotted disc 30 mounted on the output shaft 24 of the meter 18. The pulse generator 28 includes a light source on one side of the slotted disc 30, a light detector on the other side of the disc 30, and generates pulses in proportion to the number of slots in the disc which pass between the source and detector, which is proportional to the quantity of fuel pumped. A number of these pulse generators are commercially available, and one may be selected to produce an appropriate number of output pulses (for example one thousand) for each gallon of gasoline dispensed. This pulse train is then directed as an input to an electronic display 32 which directly displays the quantity of product dispensed.

In a completely electronic system, this pulse train would then be utilized to derive other pulse trains, such as a pulse train which represents the price of the dispensed product. Such a system is disclosed in U.S. patent 3,934,756. Alternatively, a hybrid approach may be utilized in which the mechanical computer output shaft 34, the rotational movement of which is proportional to the price of the dispensed product, drives a second pulse generator 36, similar to pulse generator 28, rather than display wheels as explained above. Generator 36 then generates electric pulses the number of which is proportional to the rotational movement of shaft 34 and accordingly proportional to the price of the dispensed product. This pulse train is then directed as a second input to the electronic display 32 which generates a display price output in accordance with the number of pulses received from generator 36. All the structures described thus far is known in the art.

In accordance with the disclosed embodiment an additive storage reservoir 38, which may contain for example five gallons of additive, is placed within the console 10. When dispensing of the additive is desired, additive is pumped by a mini pump 40 from the reservoir during a dispensing operation. Additive should be dispensed in proportion to the volume of fuel dispensed. Accordingly, the output of pulse generator 28 which produces a pulse train proportionate to the volume of product pumped, is directed via a selection switch 42 to a control circuit 44 for pump 40. Control circuit 44 causes pump 40 to pump a given quantity of additive for each pulse received. For instance, circuit 44 could cause an electric motor, which drives a positive displacement pump, to turn one revolution for each received pulse. The design of control circuit 44 is well known in the art and need not be explained in detail here.

In one designed embodiment, it is desired to have the number of pulses reaching control circuit 44 be one pulse per gallon. That one pulse would then cause the motor driving pump 40 to proceed through one revolution and turn off. That one revolution would then cause the pumping of a given amount of additive, for instance three cc, through a micrometer 46, a line 48, and then directly into the fuel being dispensed. The one pulse per gallon may be derived directly from a pulser 28 designed to deliver one pulse at the beginning of each dispensed gallon. Alternatively, if a pulser is already present in the dispenser, delivering for instance one thousand pulses per gallon, a divide by one thousand circuit may be utilized and specifically designed to produce a pulse upon receipt of the first pulse from the pulser and a pulse then for each additional thousand pulses received thereafter. Meter 46 may be selected to deliver a given number of pulses for the quantity of additive dispensed such that its pulses may be directly added to the pulses from pulser 36. Any problem with coincident pulses from the two meters may be eliminated in a conventional fashion. The meter 46 may be a commercially available micrometer which produces one pulse per cc, such as is available from Brooks Instrument Company.

The system may be designed with appropriate check valves at the input and output of pump 40 and where additive line 48 joins the fuel dispensing line to ensure the proper flow of additive through the system. Also, it may be desired to run a separate flexible line from the console directly to the nozzle 22, for instance with another check valve at the nozzle 22, to ensure that the additive is dispensed to the proper customer.

It is desirable that the additive select switch be opened after each dispensing operation to ensure that additive is dispensed only to customers who desire the option. Accordingly a mechanical reset 43 is coupled to the reset mechanism for the pump to open switch 42 each time the pump and meter are reset. After a resetting operation, the attendant must then close additive select switch 42 for the additive to be dispensed.

It is apparent that many embodiments of the present invention may be designed. A purely electronic system, as mentioned above, may be utilized in which pulses from the various pulse trains are utilized to directly drive the additive dispensing system. Alternatively, the hybrid embodiment disclosed herein with a mechanical computer driving an electronic pulser may be utilized. Also, the number of pulses per volume of fluid may differ from embodiment to embodiment.

The invention claimed is:

1. In a system for dispensing fuel having an underground storage tank for the fuel, a first pump for pumping the fuel from the storage tank, a first meter for measuring the quantity of fuel dispensed, electronic means responsive to electronic pulses for computing the cost to the customer of the quantity of fuel dispensed and for displaying the quantity and cost of fuel dispensed, the improvement comprising a system for allowing a customer to select an option of having an additive automatically added to the dispensed fuel and having the price of the additive computed into the cost display and including:

a. a storage reservoir for the additive which is separate from the underground storage tank for the fuel;

b. a second pump coupled to the storage reservoir for pumping slugs of additive from the storage reservoir to the fuel being dispensed;

c. a second meter for metering the quantity of additive dispensed by said second pump and for producing an output indicative thereof;

d. means for producing electrical pulses indicative of the cost and quantity of fuel and the cost of the additive dispensed;

e. means for coupling the electrical pulses indicative of the cost of additive dispensed to the display for inclusion with the electrical pulses indicative of the costs of the fuel dispensed whereby the amount of fuel dispensed and total cost of fuel and additives is shown by the display; and f. selector means for selectively allowing additive to be dispensed along with the dispensed fuel at the option of the customer, said selector means, when in an additive dispensing position, activating said first meter to activate said second pump, said selector means including a switch means for optionally coupling the electrical pulses indicative of the quantity of fuel dispensed to the second pump.

2. A system as set forth in claim 1 wherein said switch means includes a reset means for resetting said switch means to an open position before a new dispensing operation is started.

3. A system as set forth in claim 2 wherein said storage reservoir is located within a dispensing console.

4. A system as set forth in claim 3 wherein said switch means includes a reset means for resetting said switch means to an open position before a new dispensing operation is started.

5. A system as set forth in claim 4, wherein said storage reservoir is located within a dispensing console.

6. A system as set forth in claim 1 wherein the display comprises an electronic display means responsive to electrical pulses to display cost and quantity of dispensed product, and wherein the system includes means for producing electrical pulses indicative of the quantity of fuel dispensed, wherein said second pump is coupled to pump slugs of additive in response to the electrical pulses indicative of the quantity of fuel dispensed, and said selector means includes a switch means for selectively or not coupling the electrical pulses indicative of the quantity of fuel dispensed to the second pump.

* * * * *